US006490873B2

(12) United States Patent
Tchougounov et al.

(10) Patent No.: US 6,490,873 B2
(45) Date of Patent: Dec. 10, 2002

(54) ICE MAKER AND METHOD OF MAKING ICE

(75) Inventors: Andrei Tchougounov, Ligonier, IN (US); Robert G. Cox, Goshen, IN (US); Donald E. DeWitt, Syracuse, IN (US)

(73) Assignee: Dekko Heating Technologies, Inc., North Webster, IN (US)

( * ) Notice: Subject to any disclaimer, the term of this patent is extended or adjusted under 35 U.S.C. 154(b) by 0 days.

(21) Appl. No.: 09/748,411

(22) Filed: Dec. 26, 2000

(65) Prior Publication Data

US 2001/0011460 A1 Aug. 9, 2001

Related U.S. Application Data

(63) Continuation-in-part of application No. 09/499,011, filed on Feb. 4, 2000, now Pat. No. 6,223,550, which is a continuation-in-part of application No. 09/285,283, filed on Apr. 2, 1999, now Pat. No. 6,082,121.

(51) Int. Cl.[7] ..... F25C 1/12
(52) U.S. Cl. ..... 62/71; 62/135; 62/353
(58) Field of Search ..... 62/71, 135, 353, 62/347

(56) References Cited

U.S. PATENT DOCUMENTS

| | | | | | |
|---|---|---|---|---|---|
| 948,311 | A | | 2/1910 | Bull | 62/356 |
| 1,963,842 | A | | 6/1934 | Gay | 62/105 |
| 2,775,101 | A | | 12/1956 | Hanson | 62/356 |
| 3,196,624 | A | | 7/1965 | Reynolds | 62/71 |
| 3,274,792 | A | | 9/1966 | Weil et al. | 62/354 |
| 3,300,998 | A | * | 1/1967 | Jacobus et al. | 62/135 |
| 3,306,072 | A | * | 2/1967 | Dahlgren et al. | 62/135 |
| 3,367,127 | A | * | 2/1968 | Walker | 62/353 |
| 3,654,772 | A | | 4/1972 | Curry, III | 62/353 |
| 3,678,701 | A | | 7/1972 | Powell et al. | 62/353 |
| 3,708,992 | A | | 1/1973 | Clearman et al. | 62/71 |
| 3,850,008 | A | * | 11/1974 | Frazier | 62/353 |
| 3,896,631 | A | | 7/1975 | Morrison | 62/71 |
| 3,984,996 | A | | 10/1976 | Bright | 62/353 |
| 4,003,214 | A | | 1/1977 | Schumacher | 62/340 |
| 4,183,222 | A | | 1/1980 | Swanson | 62/71 |
| 4,355,522 | A | | 10/1982 | Gorski et al. | 62/340 |
| 4,429,543 | A | | 2/1984 | Fischer | 62/347 |
| 4,732,006 | A | | 3/1988 | Fischer | 62/71 |
| 4,833,894 | A | * | 5/1989 | Chesnut | 62/135 |
| 4,901,539 | A | | 2/1990 | Garber et al. | 62/356 |
| 5,167,132 | A | | 12/1992 | Meier | 62/356 |
| 6,082,121 | A | * | 7/2000 | Marsh et al. | 62/75 |

FOREIGN PATENT DOCUMENTS

| | | | |
|---|---|---|---|
| DE | 351706 | 3/1921 | 62/356 |

* cited by examiner

*Primary Examiner*—William E. Tapolcal
(74) *Attorney, Agent, or Firm*—Taylor & Aust, P.C.

(57) ABSTRACT

An ice maker includes a mold with least one cavity for containing water therein for freezing into ice. A temperature sensor is positioned in association with the mold and provides an output signal. An auger is positioned partly within the at least one mold cavity. A mechanical drive rotatably drives the auger. A controller is coupled with the sensor and the drive, and controls operation of the drive depending upon the output signal from the sensor.

14 Claims, 2 Drawing Sheets

ICE MAKER AND METHOD OF MAKING ICE

CROSS REFERENCE TO RELATED APPLICATIONS

This is a continuation-in-part of U.S. patent application Ser. No. 09/499,011, entitled "ICE MAKER", filed Feb. 4, 2000, now U.S. Pat. No. 6,223,550, which is a continuation in part of U.S. patent application Ser. No. 09/285,283, entitled "ICE MAKER", filed Apr. 2, 1999, now U.S. Pat. No. 6,082,121.

BACKGROUND OF THE INVENTION

1. Field of the Invention

The present invention relates to freezers, and, more particularly, to ice makers within freezers.

2. Description of the Related Art

The freezer portion of a refrigeration/freezer appliance often includes an ice cube maker which dispenses the ice cubes into a dispenser tray. A mold has a series of cavities, each of which is filled with water. The air surrounding the mold is cooled to a temperature below freezing so that each cavity forms an individual ice cube. As the water freezes, the ice cubes become bonded to the inner surfaces of the mold cavities.

In order to remove an ice cube from its mold cavity, it is first necessary to break the bond that forms during the freezing process between the ice cube and the inner surface of the mold cavity. In order to break the bond, it is known to heat the mold cavity, thereby melting the ice contacting the mold cavity on the outermost portion of the cube. The ice cube can then be scooped out or otherwise mechanically removed from the mold cavity and placed in the dispenser tray. A problem is that, since the mold cavity is heated and must be cooled down again, the time required to freeze the water is lengthened.

Another problem is that the heating of the mold increases the operational costs of the ice maker by consuming electrical power. Further, this heating must be offset with additional refrigeration in order to maintain a freezing ambient temperature, thereby consuming additional power. This is especially troublesome in view of government mandates which require freezers to increase their efficiency.

Yet another problem is that, since the mold cavity is heated, the water at the top, middle of the mold cavity freezes first and the freezing continues in outward directions. In this freezing process, the boundary between the ice and the water tends to push impurities to the outside of the cube. Thus, the impurities become highly visible on the outside of the cube and cause the cube to have an unappealing appearance. Also, the impurities tend to plate out or build up on the mold wall, thereby making ice cube removal more difficult.

A further problem is that vaporization of the water in the mold cavities causes frost to form on the walls of the freezer. More particularly, in a phenomenon termed "vapor flashing", vaporization occurs during the melting of the bond between the ice and the mold cavity. Moreover, vaporization adds to the latent load or the water removal load of the refrigerator.

Yet another problem is that the ice cube must be substantially completely frozen before it is capable of withstanding the stresses imparted by the melting and removal processes. This limits the throughput capacity of the ice maker.

What is needed in the art is an ice maker which does not require heat in order to remove ice cubes from their cavities, has an increased throughput capacity, allows less evaporation of water within the freezer, eases the separation of the ice cubes from the auger and does not push impurities to the outer surfaces of the ice cubes.

SUMMARY OF THE INVENTION

The present invention provides a control system and corresponding method of operation which allows ice cubes to be automatically harvested in an efficient manor.

The invention comprises, in one form thereof, an ice maker including a mold with least one cavity for containing water therein for freezing into ice. A temperature sensor is positioned in association with the mold and provides an output signal. An auger is positioned partly within the at least one mold cavity. A mechanical drive roatably drives the auger. A controller is coupled with the sensor and the drive, and controls operation of the drive depending upon the output signal from the sensor.

The invention comprises, in another form thereof, a method of making ice in an automatic ice maker, including the steps of: providing a mold in at least one cavity; filling at least one mold cavity at least partially with water; providing an auger at least partly within the at least one mold cavity; coupling a mechanical drive with the auger for rotatably driving the auger; coupling a controller with the drive; measuring a temperature of the mold; and controlling operation of the drive using the controller, depending upon the measured temperature of the mold.

An advantage of the present invention is that ice cubes may automatically be harvested depending upon the temperature of the mold over time, thereby increasing the throughput rate of the ice maker.

Another advantage is that a frozen or blocked fill tube may be sensed and heat applied thereto for the purpose of clearing the fill tube

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
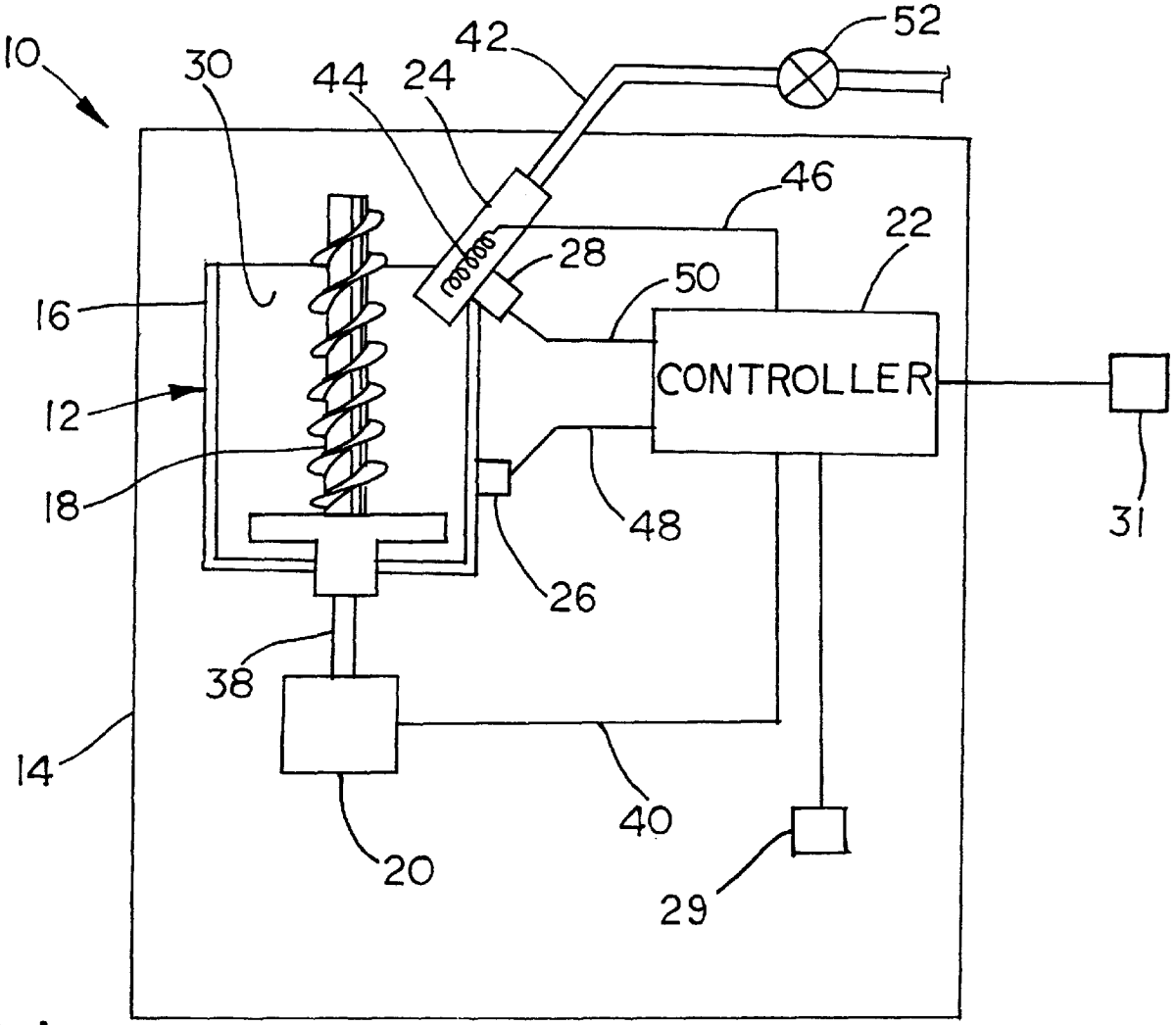
FIG. 1 is a schematic illustration of a freezer including an embodiment of an ice maker of the present invention.

Referring now to the drawings, and more particularly to FIG. 1, there is shown an embodiment of a freezer 10 including an ice maker 12 disposed within a freezer unit 14. Freezer unit 14 may be, e.g., a side-by-side arranged or vertically stacked freezer unit in a household freezer appliance.

Ice maker 12 generally includes a mold 16, an auger 18, a mechanical drive 20, a controller 22, a fill tube 24, a first temperature sensor 26 and a second temperature sensor 28. Mold 16 includes at least one mold cavity 30 for containing water therein for freezing into ice. In the embodiment shown, mold 16 includes a single mold cavity 30 with interior walls having a slight draft to allow the ice to be more easily removed therefrom. Auger 18 includes an auger shaft 32 about which a continuous flighting 36 extends from one end to the other. Auger 18 is tapered in a discharge direction to allow easier decoupling from the at least partially frozen ice cube which is formed within mold 16. For more details of a mold and tapered auger which may be utilized with ice maker 12 of the present invention, reference is hereby made by to co-pending U.S. patent application Ser. No. 09/499,011, entitled "Ice Maker", which is assigned to the assignee of the present invention and incorporated herein by reference. Drive 20 rotatably drives auger 18 within mold 16. In the embodiment shown, drive 20 is in the form of an electric motor, such as an alternating current or direct current motor, having an output shaft 38 which is coupled with and drives auger 18. Drive 20 is electrically coupled with controller 22 via line 40.

Fill tube 24 is coupled with a water line 42 and receives water from a water source (not shown), such as a common pressurized household water supply line. Fill tube 24 selectively receives water such as by using a control valve 52 for supplying water to cavity 30 within mold 16. Fill tube 24 includes a heater 44 therein which is selectively energized to melt any accumulation of ice which may build up in fill tube 24 during operation. In the embodiment shown, heater 44 is in the form of an electrical wire which is over molded within fill tube 24, and electric controller 22 via line 46. For more details for a heated fill tube 24 which may be utilized with the present invention, reference is hereby made to co-pending U.S. patent application Ser. No. 09/130,180, entitled "Heater Assembly For a Fluid Conduit With an Internal Heater", which is assigned to the assignee of the present invention and incorporated herein by reference.

First temperature sensor 26 is positioned in association with mold 16 to sense a temperature of mold 16. In the embodiment shown, first temperature sensor 26 is embedded within or carried by a sidewall of mold 16 to thereby sense a temperature of the sidewall and provide an output signal to controller 22 via line 48. Second temperature sensor 28 is positioned in association with fill tube 24 for sensing a temperature of fill tube 24. The primary functionality of second temperature sensor 28 is to determine whether fill tube 24 has become clogged with ice, as will be described in more detail hereinafter. Second temperature sensor 28 provides an output signal to controller 22 via line 50 indicative of the temperature of fill tube 24 at a selected point in time.

Sensor 29 is used to detect whether or not ice is present within an ice holding tray or bin in freezer unit 14. Sensor 29 provides an output signal to controller 22 indication whether the ice tray is already full.

Compressor 31 is also coupled with controller 22 and provides an output signal to controller 22. In particular compressor 31 provides a signal to controller 22 indicating whether compressor 31 is running or not running.

Controller 22 is used to selectively accuate drive 20, heater 44 and/or valve 52. The control of drive 20, heater 44 and valve 52 is at least in part dependent upon one or more output signals which are outputted from first temperature sensor 26, second temperature sensor 28 and/or sensor 29 to controller 22.

Figure 2:
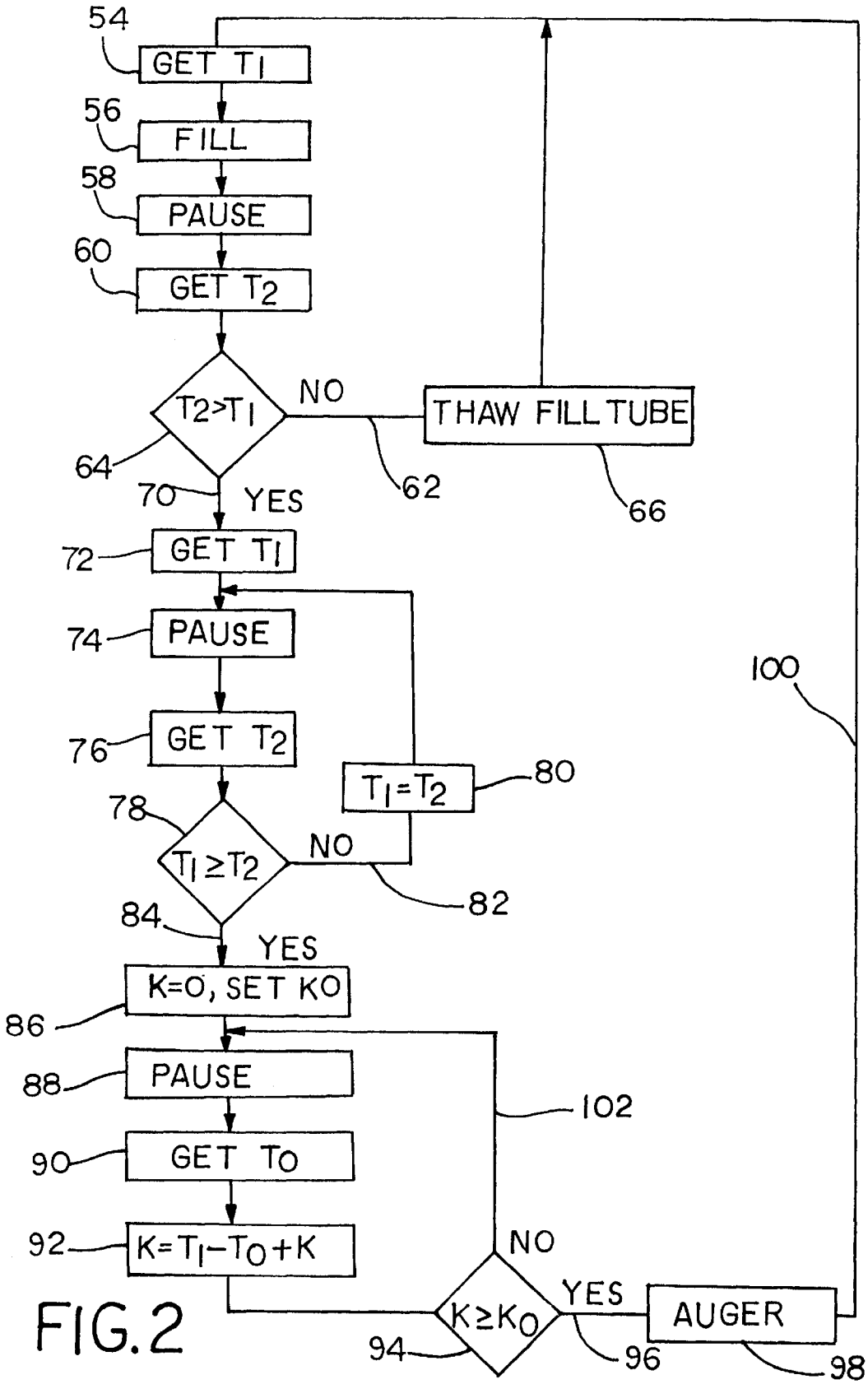
FIG. 2 is a flow chart of a method of making ice of the present invention.

Referring now to FIG. 2, there is shown a flow chart illustrating an embodiment of a method of the present invention for making ice in automatic ice maker 12 shown in FIG. 1. Ice maker 12 generally freezes ice cubes in a batch manner such that ice cubes are sequentially frozen and discharged into a suitable holding tray (not shown). The method described hereinafter corresponds to the logic processes for forming a single ice cube within ice maker 12. It will be appreciated that the method continues in a looped fashion for making additional ice cubes within ice maker 12.

Moreover, the embodiment of the present invention for making ice cubes described hereinafter is assumed to be carried out in software within suitable electronics, and thus may be easily implemented by a person of ordinary skill in the art. It is to be appreciated, however, that the embodiment of the method of the present invention described hereinafter may be carried out in software, firmware and/or hardware, depending upon the particular application.

At the beginning of a fill cycle, second temperature sensor 28 provides an output signal to controller 22 via line 50 corresponding to a first temperature T1 (block 54). Controller 22 then actuates valve 52 to fill cavity 30 within mold 16 for a predetermined period of time using assumed flow characteristics of the water flowing through fill tube 24 (block 56). Alternatively, a sensor may be provided within mold 16 to detect a "full" position of the water within cavity 30.

After cavity 30 is filled with water, a wait state occurs during which the thermal inertia of mold 16 caused by the warmer water flowing therein is allowed to stabilize (block 58). Depending upon the particular application, the wait state may range between 0 or several or many seconds. Thereafter, second temperature sensor 28 senses a second temperature T2 of fill tube 24 (block 60). It will be appreciated that at the beginning of an initial fill cycle within freezer unit 14, the temperature of fill tube 24 generally corresponds to the internal temperature within freezer unit 14. As the warmer water is injected through fill tube 24, the temperature of fill tube 24 rises. Thus, at the end of a fill cycle the second temperature T2 should be greater than the first temperature T1, assuming that fill tube 24 is unclogged and water flowed therethrough during the fill cycle. If the second temperature T2 is not greater than the first temperature T1, ice has accumulated in fill tube 24 (decision line 62 at decision block 64). Controller 22 then actuates heater 44 for a predetermined period of time to melt the ice within fill tube 24 and thereby unclog fill tube 24 (block 66). After fill tube 24 is thawed, mold cavity 30 must be filled with water to restart the fill cycle. Accordingly, control loops back to block 54 from block 66 via line 68.

After mold cavity 30 is filled with water (decision line 70 from decision block 64), it is necessary to determine the maximum temperature reached by mold 16 after being filled with water (blocks 72, 74, 76 and 80). To wit, mold 16 is generally at the temperature corresponding to the internal temperature within freezer unit 14 prior to an initial fill cycle. The water which is injected into mold 16 is at an elevated temperature (e.g., 60° F.). After mold cavity 30 is filled with water from fill tube 24, the elevated temperature of the water within mold cavity 30 causes the temperature of mold 16 to increase according to a corresponding temperature gradient curve. At some point in time, however, the temperature of mold 16 reaches a maximum level and again descends as a result of the colder temperature within freezer unit 14. Blocks 72–80 detect the maximum temperature of mold 16 after being filled with water and uses a maximum temperature to determine when an ice cube is to be harvested.

More particularly, first temperature sensor 26 provides an output signal to controller 22 via line 48 indicative of a first temperature T1 immediately after mold cavity 30 is filled with water (block 72). Thereafter, a wait state occurs for a predetermined period of time to allow the temperature of mold 16 to change (block 74). First temperature sensor 26 then provides an additional signal to controller 22 via line 48 indicative of a second temperature T2 at the point in time of the wait state (block 76). If the first temperature T1 is less than the second temperature T2 measured at the discrete point in time (decision line 82 from decision block 78), then the thermal inertia of the water within mold cavity 30 is causing the temperature of mold 16 to continue to rise and mold 16 has not yet reached a maximum temperature. Thus, the first temperature T1 is reset to the maximum temperature T2 (block 80) and the control process loops back to the input side of block 74.

On the other hand, if the first temperature T1 is greater than or equal to the second temperature T2 (decision line 84 from decision block 78), then the maximum temperature of mold 16 has been reached and mold 16 is beginning to cool.

Blocks 86, 88, 90, 92 and 94 are used to perform a numerical analysis of the temperature of mold 16 over time to determine when the ice cube may be harvested. It will be appreciated that the colder temperature in freezer unit 14 causes the temperature of mold 16 and the water therein to drop. Moreover, it will be appreciated that the temperature of the water within mold cavity 30 drops over time. Thus, freezing of ice within mold cavity 30 may be determined as a function of the temperature of mold 16 over time.

At block 86, the variable K is set to zero. Additionally, the constant K0 is set dependent upon anticipated cooling conditions within freezer unit 14. More particularly, the cooling rate of mold 16 differs, depending upon whether the compressor is running or not running within freezer 10. A determination is made as to whether the compressor is running or not running and the value of the constant K0 is set accordingly to determine whether an ice cube is to be harvested from ice maker 12.

Thereafter, a wait state occurs for a predetermined period of time (e.g. a few seconds) which allows the temperature of mold 16 to drop (block 88). The temperature T0 of the mold is then measured using first temperature sensor 26 (block 90). The variable K is then reset using the mathematical expression:

$$K=T1-T0+K$$

wherein

T1=the maximum mold temperature; and

T0=sensed temperature at discrete points in time.

The variable K is then compared with the predetermined constant K0, which may be emperically or theoretically determined. If the value of K is greater than or equal to the constant K0, thereby determining a predetermined transition, (decision line 96 from decision block 94) then the ice cube may be harvested, based on this determination, by actuating drive 20 using controller 22 to rotatably drive auger 18 (block 98). Control then loops to tie input side of block side of block 54 via line 100 for the beginning of a new fill cycle. On the other hand, if the value of K is less than the value of the constant K0 (decision line 100 from decision block 94), the ice cube is not yet ready for harvesting and control loops to the input side of block 88 via return line 102.

From the foregoing description of an embodiment of the method of the present invention for automatically making ice cubes, it will be appreciated that different logic steps may be implemented and/or interchanged and still effect the methodology of the present invention. For example, because of the thermal inertia which occurs upon heating of fill tube 24 during a fill cycle, it may be possible to switch the position of blocks 54 and 56 in FIG. 2. Other modifications are of course also possible.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ice maker, comprising:

a mold including at least one cavity for containing water therein for freezing into ice;

a temperature sensor positioned in association with said mold and providing an output signal, said output signal indicative of the degree to which freezing has occurred;

an ice removal device at least partly within said at least one mold cavity;

a mechanical drive for rotatably driving said ice removal device; and a controller coupled with each of said sensor and said drive, said controller determining when a predetermined transition has occurred dependent upon said output signal, and controlling operation of said drive dependent upon said determination.

2. An ice maker, comprising:

a mold including at least one cavity for containing water therein for freezing into ice;

a temperature sensor positioned in association with said mold and providing an output signal;

an ice removal device at least partly within said at least one mold cavity;

a mechanical drive for driving said ice removal device;

a controller coupled with each of said sensor and said drive, said controller controlling operation of said drive dependent upon said output signal from said sensor;

a fill tube positioned in association with said at least one mold cavity for filling said mold cavity with water, said fill tube including a heater; and an additional temperature sensor positioned in association with said fill tube and providing an output signal;

said controller being coupled with said heater and said additional temperature sensor, said controller actuating said heater dependent upon said output signal from said additional temperature sensor.

3. A freezer, comprising:

a freezer unit including an ice maker, said ice maker comprising:

a mold including at least one cavity for containing water therein for freezing into ice;

a temperature sensor positioned in association with said mold and providing an output signal, said output signal indicative of the degree to which freezing has occurred;

an ice removal device at least partly within said at least one mold cavity;

a mechanical drive for rotatably driving said ice removal device; and a controller coupled with each of said sensor and said drive, said controller determining when a predetermined transition has occurred, dependent upon said output signal, and controlling operation of said drive dependent upon said determination.

4. A freezer, comprising:

a freezer unit including an ice maker, said ice maker comprising:

a mold including at least one cavity for containing water therein for freezing into ice;

a temperature sensor positioned in association with said mold and providing an output signal;

an ice removal device at least partly within said at least one mold cavity, a mechanical drive for driving said ice removal device; and a controller coupled with each of said sensor and said drive, said controller controlling operation of said drive dependent upon said output signal from said sensor;

a fill tube positioned in association with said at least one mold cavity for filling said mold cavity with water, said fill tube including a heater; and an additional temperature sensor positioned in association with said fill tube and providing an output signal, said controller being coupled with said heater and said additional temperature sensor, said controller actuating said heater dependent upon said output signal from said additional temperature sensor.

5. The freezer unit of claim 3, wherein said that ice removal device comprises an auger.

6. A method of making ice in an automatic ice maker, comprising the steps of providing a mold including at least one cavity;

filling said at least one mold cavity at least partially with water;

providing an ice removal device at least partly within said at least one mold cavity;

coupling rotatably a mechanical drive with said ice removal device;

coupling a controller with said drive;

measuring a temperature of said mold; and controlling operation of said drive using said controller determining when a predetermined transition has occurred, dependent upon said measured temperature of said mold, said measured temperature being indicative of the degree to which freezing has occurred.

7. The method of claim 6, including the steps of:

positioning a temperature sensor in association with said mold;

coupling said controller with said sensor; and outputting a signal from said sensor to said controller; and wherein said controlling step is dependent upon said sensor signal.

8. A method of making ice in an automatic ice maker, comprising the steps of providing a mold including at least one cavity;

filling said at least one mold cavity at least partially with water;

providing an ice removal device at least partly within said at least one mold cavity;

coupling a mechanical drive with said ice removal device;

coupling a controller with said drive;

measuring a temperature of said mold;

controlling operation of said drive using said controller, dependent upon said measured temperature of said mold;

positioning a temperature sensor in association with said mold;

coupling said controller with said sensor;

outputting a signal from said sensor to said controller;

wherein said controlling step is dependent upon said sensor signal;

sensing a plurality of temperatures of said mold over time; and numerically integrating said temperatures over said time;

said controlling step being dependent upon said numerical integration.

9. The method of claim 8, including the steps of:

determining a maximum mold temperature after said filling step;

setting a first temperature T1 equal to said maximum mold temperature;

sensing one of said plurality of temperatures of said mold;

setting a second temperature T2 equal to said one temperature; and subtracting said first temperature T1 minus said second temperature T2.

10. The method of claim 9, including the steps of:

before said subtracting step, setting a variable K=0;

after said subtracting step, resetting said variable K using the mathematical expression:

$$K=T1-T2+K;\text{ and}$$

repeating said steps of sensing said one of said plurality of temperatures, setting said second temperature, and resetting said variable K.

11. A method of making ice in an automatic ice maker, comprising the steps of providing a mold including at least one cavity;

filling said at least one mold cavity at least partially with water using a fill tube positioned in association with said at least one mold cavity, said fill tube including a heater; and including the steps of:

positioning an additional temperature sensor in association with said fill tube;

coupling said controller with said heater and said additional temperature sensor;

outputting a signal from said additional sensor to said controller; and actuating said heater using said controller, dependent upon said output signal from said additional temperature sensor;

providing an ice removal device at least partly within said at least one mold cavity;

coupling a mechanical drive with said ice removal device;

coupling a controller with said drive;

measuring a temperature of said mold; and controlling operation of said drive using said controller, dependent upon said measured temperature of said mold.

12. The method of claim 11, including the sub-steps of measuring a first temperature of said fill tube using said additional sensor;

outputting a first signal from said additional sensor to said controller representing said first temperature;

filling at least one said mold cavity using said fill tube;

measuring a second temperature of said fill tube using said additional sensor; and outputting a second signal from said additional sensor to said controller representing said second temperature;

said actuating step being carried out dependent upon said first signal and said second signal.

13. The method of claim 12, including the step of comparing said first temperature and said second temperature, said actuating step being carried out if said second temperature is not greater than said first temperature.

14. The method of claim 11, wherein said that ice removal device comprises an auger.

* * * * *